United States Patent [19]

Satomi et al.

[11] 4,399,431

[45] Aug. 16, 1983

[54] ALARM OR WARNING DEVICE FOR SIGNALING LEFT-BEHIND MASTER OR ORIGINAL

[75] Inventors: Toyokazu Satomi, Yokohama; Yoshiaki Kanmoto, Toyko; Yasuhiro Tabata, Kawasaki, all of Japan

[73] Assignee: Ricoh Co., Ltd., Tokyo, Japan

[21] Appl. No.: 309,399

[22] Filed: Oct. 7, 1981

[30] Foreign Application Priority Data

| | | | |
|---|---|---|---|
| Oct. 23, 1980 | [JP] | Japan | 55-147587 |
| Nov. 6, 1980 | [JP] | Japan | 55-155157 |
| Nov. 10, 1980 | [JP] | Japan | 55-156976 |

[51] Int. Cl.[3] ..... G08B 13/14

[52] U.S. Cl. ..... 340/568; 340/673; 340/679; 367/93

[58] Field of Search ..... 340/568, 673, 674, 679; 367/93

[56] References Cited

U.S. PATENT DOCUMENTS

| | | | |
|---|---|---|---|
| 3,431,549 | 3/1969 | Tullio et al. | 367/93 |
| 3,623,058 | 11/1971 | Maloney | 340/674 X |
| 4,291,301 | 9/1981 | Chan | 340/568 |

*Primary Examiner*—David L. Trafton
*Attorney, Agent, or Firm*—Burgess, Ryan & Wayne

[57] ABSTRACT

An alarm system for the copying machine for giving the audio or visual alarm signal when an operator leaves a copying machine without taking a master or original out of it after a copying operation. The alarm system includes a master detection means for detecting whether or not a master or original is set on a master or original stand and either a copy detection means for detecting whether or not one or more copies are present in a copy discharge tray or an operator detection means for detecting whether an operator is within a predetermined range from the copying machine. The alarm system is activated if, after a predetermined number of copies have been printed, the copy detection means detects the absence of a copy in the discharge tray or the operator detection means detects that the operator is out of a predetermined range when the master or original detection means detects the presence of the master on the master or original stand, whereby the audio or visual warning signal is given to the operator so as to take out the master or original.

5 Claims, 14 Drawing Figures

ALARM OR WARNING DEVICE FOR SIGNALING LEFT-BEHIND MASTER OR ORIGINAL

BACKGROUND OF THE INVENTION

The present invention relates to an alarm system for the copying machine for giving the audio or visual warning signal to an operator if he or she leaves the copying machine without taking a master after the completion of copying operation.

In general, various persons use one copying machine and it occurs very frequently that, after obtaining a desired number of copies, one gives attention only to taking out the copies from the discharge tray and forgets to take out his or her master from the master stand. If the copying machine is used so very frequently that the next user is waiting, he or she immediately notices the master left behind and can give the warning to the former user who left behind the master. However, when the master is left over the master stand for a long time, it becomes difficult to trace the owner of the left-behind master and consequently the master is lost.

In order to solve this problem, there has been devised and demonstrated an alarm system of the type in which a master detection switch and a power switch are interlocked in such a way that when the power switch is turned off without taking the master out of the copying machine, an alarm indicator is activated. This system has the distinctive defect that the alarm indicator remains deactivated unless the power switch is turned off. As a result, this system cannot be applied to the dry-type copying machine which is normally kept connected to the power supply.

There has been also proposed a master detection device of the type comprising a light source and a light sensor both of which are disposed under a contact glass of a copying machine and a reflecting mirror mounted on a pressure plate so that the presence or absence of a master on the contact glass is detected by whether the light sensor does not receive or does receive the light reflected back from the reflecting mirror. There has been further proposed a master detection device comprising a switch which is turned on or off when the pressure plate is opened or closed. These master detection devices have been used only for detecting whether a master is set on the contact glass or not and are not used for attaining more useful functions.

There has been further proposed an alarm system of the type which gives the warning signal if a master is not taken out of the contact glass a predetermined time interval after the completion of copying operation. However, it is difficult to set a suitable time interval. That is, if a time interval is too short, the warning signal is generated before the operator takes out the used master and sets the next master on the contact glass. On the other hand, if a time interval is too long, the warning signal is generated only after the operator has already left.

SUMMARY OF THE INVENTION

The primary object of the present invention is to provide an alarm system for a copying machine which can give to an operator the warning signal that his or her master is left behind on the contact glass if he or she leaves the copying machine without taking the master.

The alarm system in accordance with the present invention includes a master detection means for detecting whether or not a master is set on the contact glass and either a copy detection means for detecting whether or not one or more copies exist in the copy discharge tray or an operator detection means for detecting whether or not an operator is within a predetermined range from the copying machine. Alternatively, the alarm system can have both the copy and operator detection means. If, after the completion of one copying operation, the operator takes out only the prepared copies from the discharge tray and leaves the copying machine without taking the master therefrom, the alarm system is activated to give the operator the warning signal that the master is still set on the contact glass and must be taken out. To put in another way, if the master detection means detects that the master is still set on the contact glass after the completion of one copying operation when the operator detection means detects that the operator is out of a predetermined range from the copying machine, the warning signal is generated.

According to one aspect of the present invention, an ultrasonic range finder is used as the operator detection means. A time interval from the time when the ultrasonic beam is transmitted from a transmitter to the time when the ultrasonic beam reflected back from the operator is received by a receiver or ultrasonic detector is compared with a reference time interval to detect whether the operator is within a predetermined range or not. As a result, the highly reliable operator detection can be ensured.

The above and other objects, effect and features of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 1:
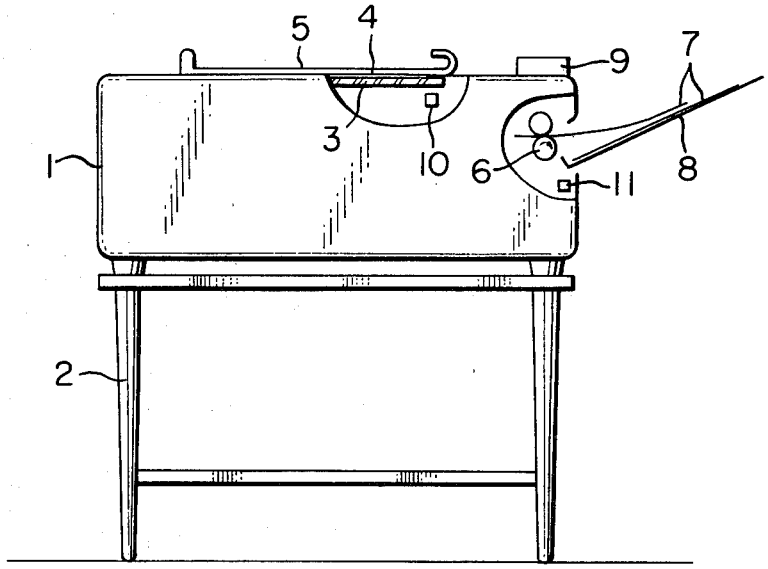
FIG. 1 is a side view of a copying machine incorporating an alarm system of the present invention and shows the location of a master sensor and a copy sensor.
Figure 2:
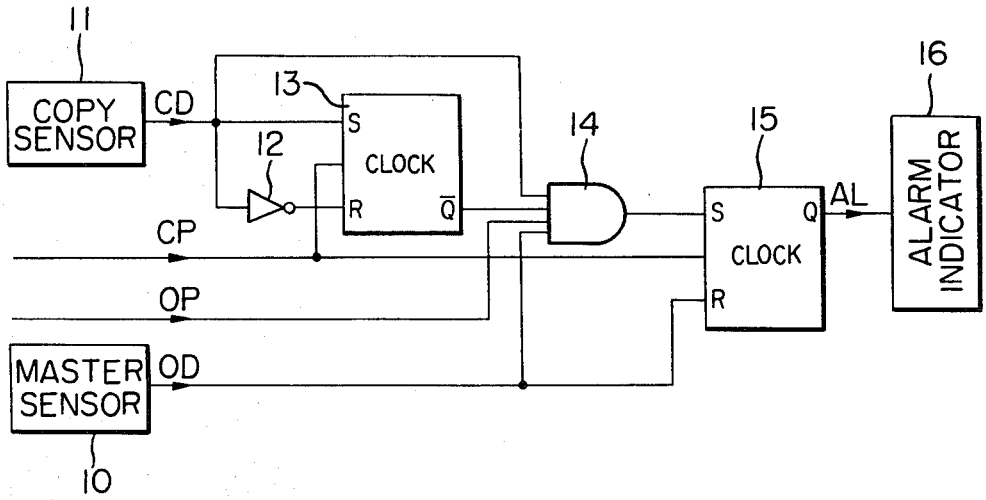
FIG. 2 is a circuit diagram of the first embodiment.
Figure 3:
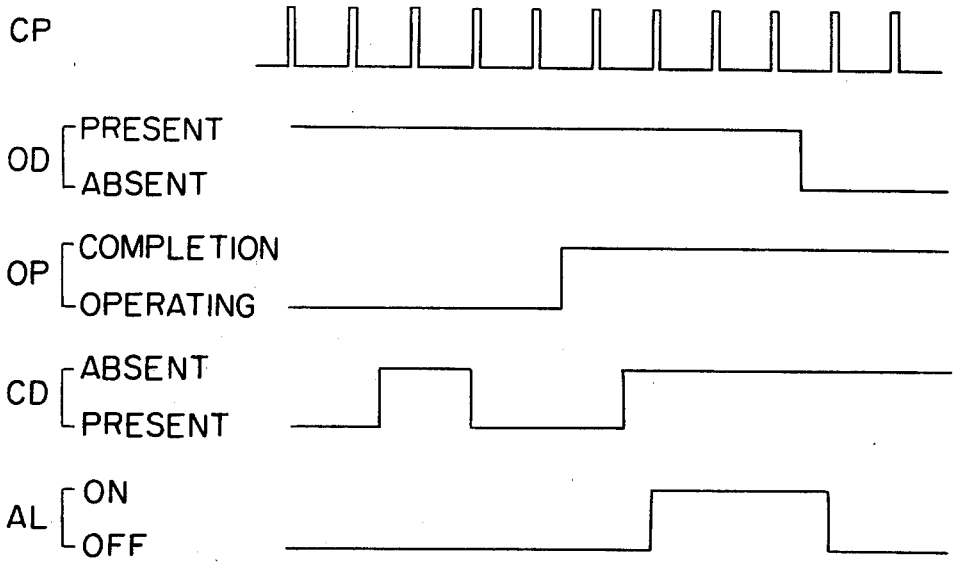
FIG. 3 shows various waveforms used to explain the mode of operation of the first embodiment.

First Embodiment, FIGS. 1 through 3

In FIGS. 1 and 2 is shown a first embodiment of the present invention. In FIG. 1 is shown the arrangement of a master sensor and a copy sensor while in FIG. 2 is shown the construction of an alarm signal generating circuit.

Referring to FIG. 1, a copying machine 1 is placed on a table 2 and a master 4 is placed over a contact glass 3 and is pressed against it with a pressure plate 5. A copy 7 is discharged through a pair of discharge rollers 6 into a tray 8. The copying machine 1 includes an operating-and-display board 9. According to the present invention, the copying machine 1 further includes a master sensor 10 for sensing whether or not the master 4 is placed on the contact glass 3 and a copy sensor 11 for sensing whether or not the copy 7 is present in the discharge tray 8. The master sensor 10 comprises, in combination, a light source and a light sensor which intercepts the light reflected back from the master 4 over the contact glass 3. The copy sensor 11 may be similar in construction and mode of operation to the master sensor 10, but the discharge tray 8 must be made of a transparent material. If the tray 8 is made of an opaque material, a portion adjacent to the copy sensor 11 must be cut out so that the light reflected back from the copy 7 can impinge on the light sensor of the copy sensor 11.

The alarm signal generating circuit shown in FIG. 2 includes an inverter 12, flip-flops 13 and 15, an AND gate 14 and an alarm indicator 16 generating a visual or audible warning signal. The alarm indicator 16 is, for example, a flash lamp or a buzzer. The alarm or warning signal generating circuit receives clock signals CP, an operating signal OP representing that the copy machine is operating, a master detection signal OD from the master sensor 10 and a copy detection signal CD from the copy sensor 11. The operating signal OP may be any of the signals generating by the conventional copying machine for accomplishing a predetermined sequence of operation. For instance, it may be a signal which is generated upon completion of a predetermined number of copying cycles so that the feed of copying paper can be interrupted. Alternatively, it may be a signal which is generated when the counter has counted the last of a predetermined number of copies so that the lamp for illuminating the original can be turned off.

Next, referring further to FIG. 3, the mode of operation of the first embodiment will be described. First, the operator places the master 4 over the contact glass 3 and presses the former over the latter with the pressure plate 5. With the keyboard 9 the operator feeds the required commands; that is, the size and number of copies to be printed, a desired tone and so on. Thereafter, the operator pushes a start button (not shown) so that the copying machine 1 starts printing and the printed copies 7 are discharged into and stacked in the discharge tray 8. After a predetermined number of copies have been printed, the operation of the copying machine 1 is automatically stopped and the copy counter (not shown) on the keyboard 9 automatically returns to zero. Now assume that during the copying operation, the operator takes out the copies 7 from the discharge tray 8. Then, as shown at CD in FIG. 3, the copy detection signal CD goes HIGH, but the operating signal OP remains in the low state so that the output from the AND gate 14 remains in the low state. As a result, the output signal AL from the flip-flop 15 remains also at the low level so that the alarm indicator 16 remains de-energized or disabled. However, after the copying operation has been completed (the operating signal OP going HIGH) and if every copy 7 is taken out of the discharge tray 8 (the copy detection signal CD going HIGH) and the master 4 still remains over the contact glass 3 (the master detection signal OD being at the high level), then, the high output signal is derived from the AND gate 14 so that the alarm signal AL is derived from the flip-flop 15 and consequently the alarm indicator 16 is energized to give the warning signal to the operator. If the warned operator takes out the master or original 4 from the contact glass 3, the master detection signal OD changes to the low level so that no output signal is derived from the AND gate 14 and consequently the alarm indicator 16 is de-energized.

In summary, according to the first embodiment of the present invention, the warning signal is generated when (1) the copying operation has been completed; (2) the copy detection signal CD from the copy sensor 11 goes HIGH; and (3) the master detection signal OD from the master sensor 10 remains at the high level, but the warning signal disappears when the operator remove his or her master 4 from the operating machine so that the master detection signal OD from the sensor 10 goes LOW.

Figure 4:
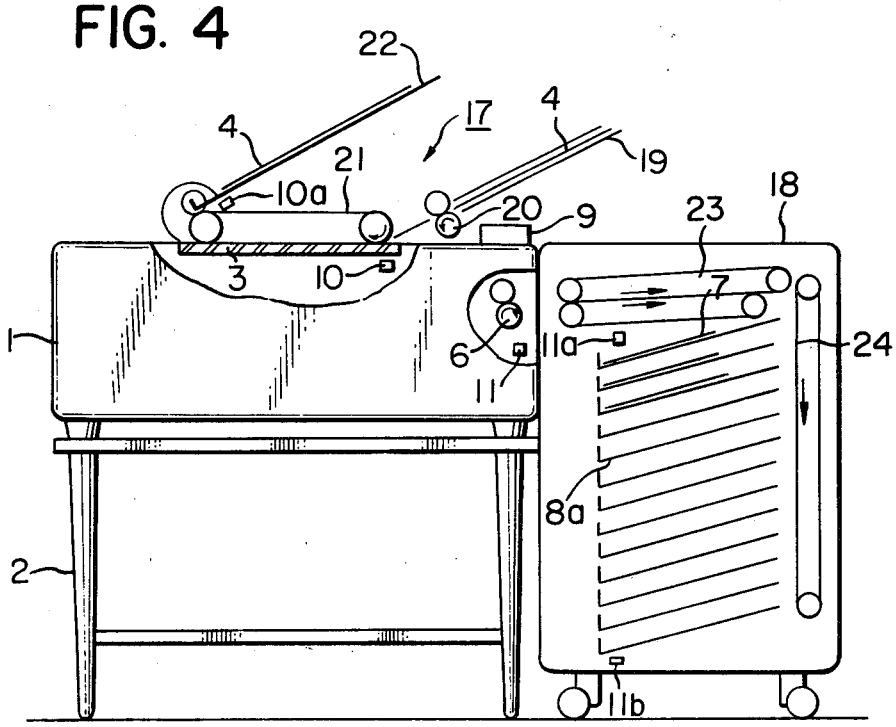
FIG. 4 is a side view of a copying machine incorporating a modified first embodiment of the present invention and shows the locations of a master sensor and a copy sensor.

Modification, FIG. 4

In FIG. 4 is shown a modification of the first embodiment in which the pressure plate 5 is removed and an automatic document feeder, ADF, 17 is connected and instead of the discharge tray 8, a collator 18 is connected to the copying machine 1. In this case, the master and copy sensor 10 and 11 are deactivated and instead, a master sensor 10*a* incorporated in the ADF 17 and a copy sensor comprising a light source 11*a* and a light sensor 11*b* which are disposed on the collator 18 are used. Therefore, discharge trays 8*a* must be made a transparent material, but if they are made of an opaque material, they must be partially cut out so that the light emitted from the light source 11*a* can reach the light sensor 11*b* when all the trays 8*a* are empty.

A stack of masters 4 is placed upon a master feeder 19 and they are fed one by one by a pair of feed rollers 20 to be inserted between a conveyor belt 21 and the contact glass 3. When the master 4 is brought to the copying position on the contact glass 3, the conveyor belt 21 is stopped and then the copying operation is started. After a predetermined number of copies have been printed, the conveyor belt 21 is started again so that the master 4 is discharged to and stacked over a master discharge stand 22. The printed copy 7 is discharged through a pair of discharge rollers 6, horizontal and vertical conveyor belts 23 and 24 into the tray 8*a* starting from the uppermost one. More specifically, a predetermined number of copies of the first page are distributed into the trays 8*a* one at a time from the uppermost one. In like manner, the copies of the second page are distributed and this procedure is repeated. As a result, the copies are stacked in each tray 8*a* in the order of their pages.

In this modification, the warning or alarm signal is generated in a manner substantially similar to that described in conjunction with the first embodiment with reference to FIG. 2.

Figure 5:
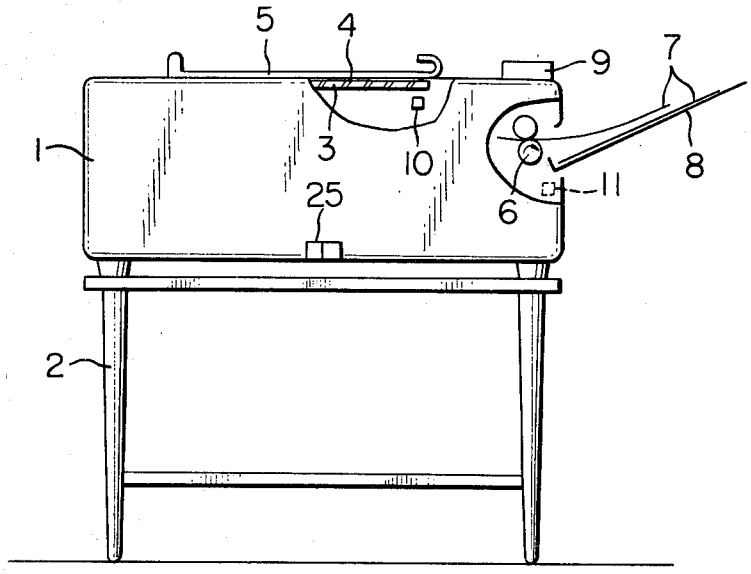
FIG. 5 is a side view of a copying machine incorporating a second embodiment of the present invention and shows the locations of a master sensor and an operator sensor.
Figure 6:
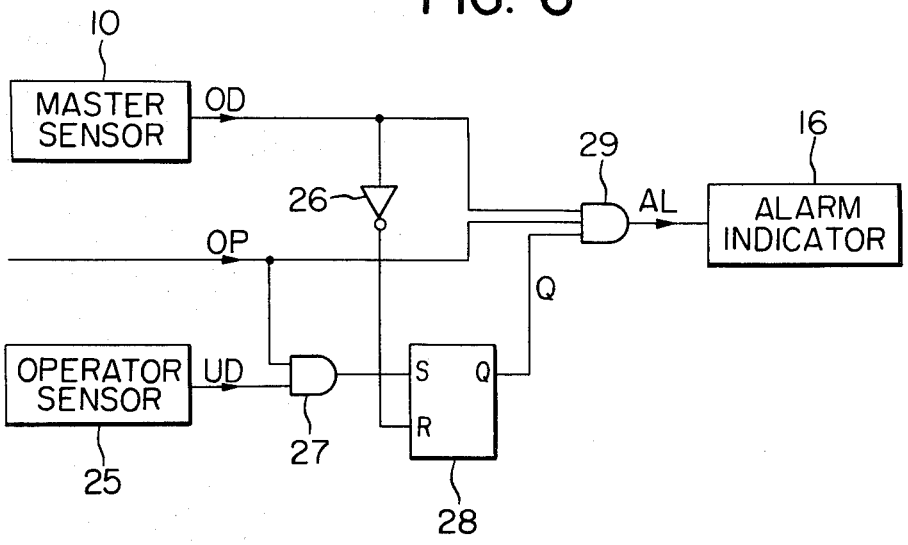
FIG. 6 is a circuit diagram of the second embodiment.
Figure 7:
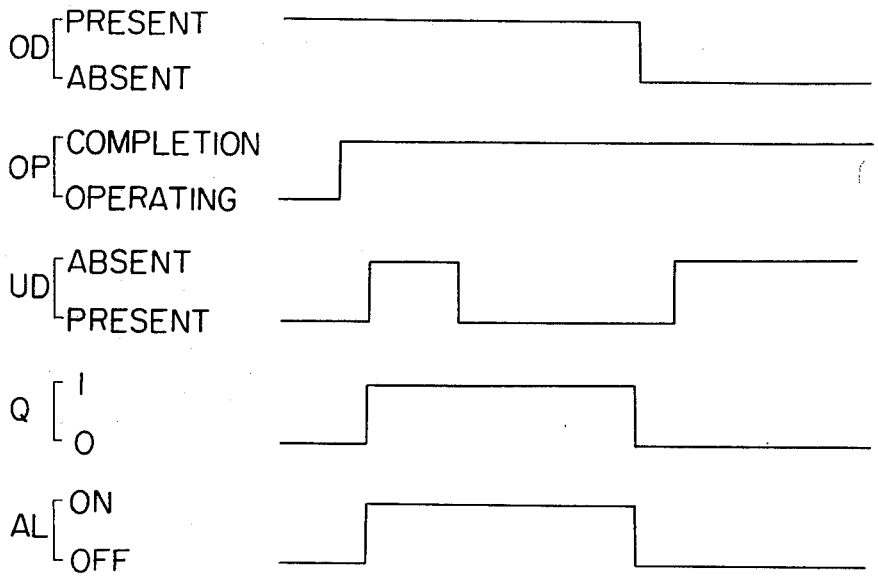
FIG. 7 shows various waveforms used to explain the mode of operation of the second embodiment.

Second Embodiment, FIGS. 5, 6 and 7

"Leaving-a-master-behind" means that the operator has left the copying machine leaving behind the master over it unconsciously after he or she has obtained a desired number of copies. Therefore, it would be more effective to give a warning or alarm signal an operator leaving the copying machine without taking his or her master by providing an operator sensor for sensing whether or not the copying machine is being attended by the operator or whether or not the operator is present in addition to the master sensor of the type described previously.

The second embodiment of the present invention which will be described in detail with reference to FIGS. 5 through 7 is provided with such operator sensor. Referring to FIG. 5, instead of the copy sensor 11 of the first embodiment, an operator sensor 25 is provided which emits the ultrasound or light beam, receives the beam reflected from the operator and measures the time interval between the transmission of the beam and reception of the reflected beam, thereby detecting whether or not the operator is within a predetermined range from the copying machine.

An alarm signal generating circuit of the second embodiment is shown in FIG. 6 and comprises an inverter 26, AND gates 27 and 29 and a flip-flop 28. In addition to the master detection signal OD from the master sensor 10 and the operating signal OP of the first embodiment, the alarm signal generating circuit receives the operator detection signal UD from the operator sensor 25 and generates the alarm signal AL which is applied to the alarm indicator 16.

Next, referring further to FIG. 7, the mode of operation of the second embodiment will be described. It is assumed that the operator detection signal UD remains at the low state when the operator is within a predetermined range from the copying machine, but goes HIGH when the operator is out of range; that is, when the operator is not attending the copying machine. When the coping machine is printing copies, the master detection signal OD remains at the high level (the master 4 is placed over the contact glass 3); the operating signal OP remains at the low level; and the operator detection signal UD also remains at the low level. As a result, the Q output from the flip-flop 28 remains at the low level so that the output from the AND gate 29 that is, the alarm signal AL remains at the low level. As a consequence, the alarm indicator 16 remains de-energized.

However, when a predetermined number of copies have been printed, the operating signal OP goes HIGH. If the operator is leaving the copying machine without taking the master, the operator detection signal UD goes high while the master detection signal OD remains at the high state so that the Q output from the flip-flop 28 goes HIGH. As a result, the output from the AND gate 29 goes high; that is, the alarm signal AL is derived so that the alarm indicator 16 is energized to give the warning signal to the operator. Then, the operator comes back and takes the master off the copying machine so that the master detection signal OD drops to the low level. As a consequence, the high-level signal is applied to the R input of the flip-flop 28 so that the Q output drops to the low level and consequently the output AL of the AND gate 29 drops to the low level. As a result, the alarm indicator 16 is de-energized.

Figure 8:
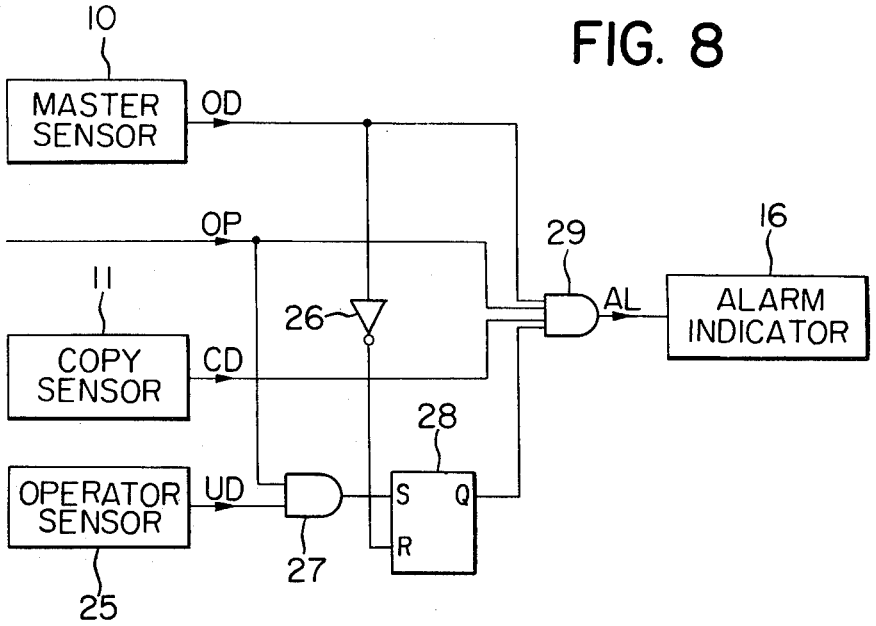
FIG. 8 is a circuit diagram of a third embodiment of the present invention.
Figure 9:
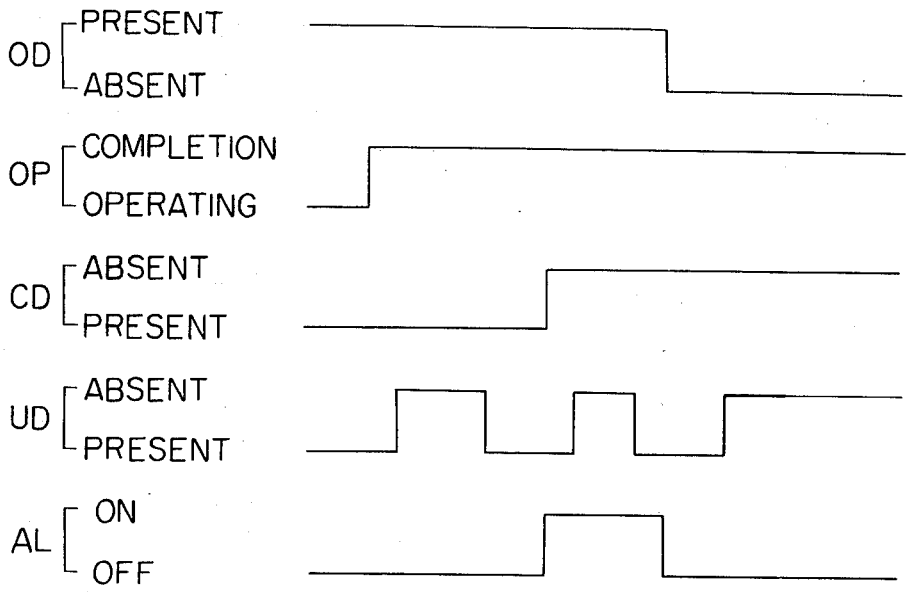
FIG. 9 shows various waveforms used to explain the mode of operation thereof.

Third Embodiment, FIGS. 8 and 9

When a large number of copies are being prepared, it frequently happens that the operator leaves the copying machine. In the case of the second embodiment, every time when a predetermined number of copying cycles is accomplished and if the operator is not in the vicinity of the copying machine, the warning signal is generated, which is rather inconvenient or annoying. Therefore, according to a third embodiment of the present invention, in addition to the master sensor 10 and the operator sensor 25, the copy sensor 11 is added so that only when the copying operation has been completed and if the operator leaves the copying machine with the prepared copies but without taking the master out of the copying machine, the warning signal is generated.

The alarm signal generating circuit of the third embodiment of the present invention is shown in FIG. 8 which, as described previously, includes the master sensor 10, the copy sensor 11 and the operator sensor 25. The mode of operation of the third embodiment can be readily understood when reference is made to FIG. 9. That is, if the copies still remain in the tray even after the copying operation has been completed (the operating signal OP being at the high level) and the operator has left beyond a predetermined range (the operator detection signal UD being at the high state), the copy detection signal CD remains at the low level so that the output AL from the AND gate 29 remains at the low level and consequently the alarm indicator 16 remains de-energized. However, when the operator comes back, takes the copies out of the discharge tray (the copy detection signal CD going HIGH) and leaves without taking the master out of the copying machine (the master detection signal OD remaining at the high level), the output AL of the AND gate goes HIGH so that the alarm indicator 16 is energized, giving the warning to the operator who is now leaving. If the operator then returns and takes out the master out of the contact glass 3, the master detection signal OD drops to the low level so that the output AL of the AND gate drops to the low level and consequently the alarm indicator 16 is de-energized.

The alarm signal generating circuit can be so designed and constructed that when the copy or copies are taken out of the discharge tray (that is, when the copy detection signal CD goes HIGH), the alarm indicator 16 can be energized, giving an early warning to the operator that the master remains on the contact glass and he or she must take it out before the operator leaves. That is, the "left-behind" warning signal can be given to the operator before he or she leaves the copying machine.

Figure 10:
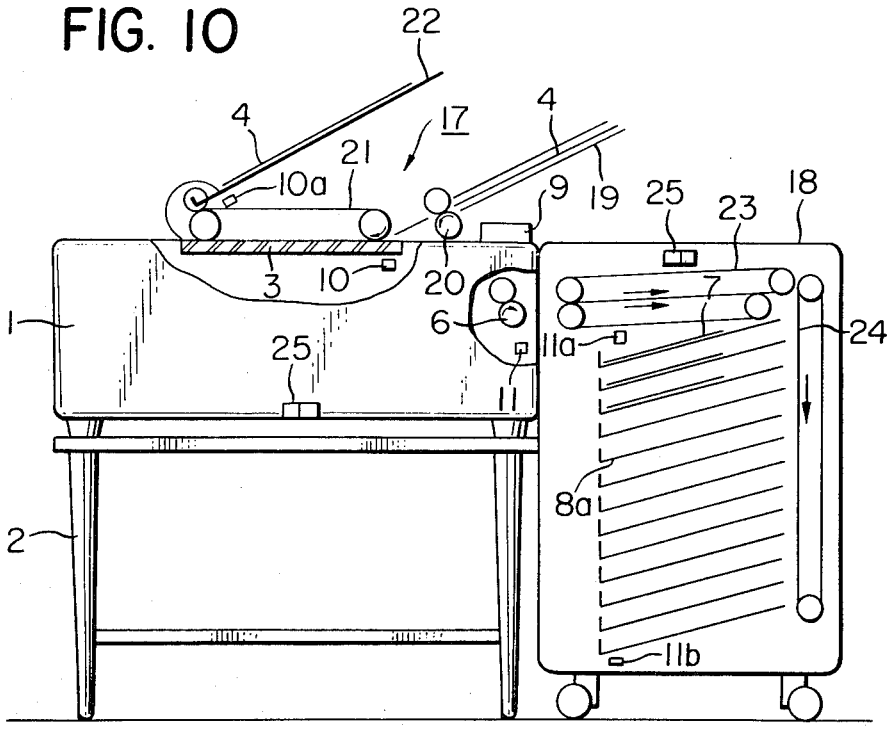
FIG. 10 is a side view of a copying machine incorporating an alarm system which is a modification of the second or third embodiment of the present invention and shows the locations of a copy sensor, an operator sensor and a master sensor.

Modification, FIG. 10

A modification of the second or third embodiment is shown in FIG. 10 which, as with the modification of the first embodiment as shown in FIG. 4, is coupled to the ADF 17 and the collator 18. In this case, the master sensor 10*a* and the copy sensor comprising 11*a* and 11*b* are used instead of the master sensor 10 and the copy sensor 11. An additional operator sensor 25 can be disposed on the collator 18 so that the more reliable and accurate detection of the operator can be ensured. It is preferable that the operator sensor 25 be disposed at a position about a few tens centimeters from the floor.

It is to be understood that the present invention can be equally applied when the copying machine is coupled only to the ADF 17 or collator 18 instead of both.

Figure 11:
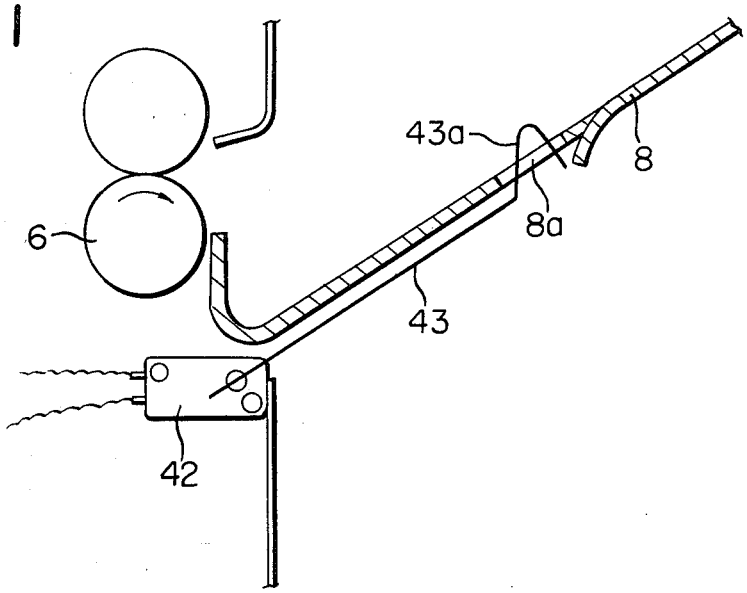
FIG. 11 shows another example of the copy sensor used in the present invention.

So far the master sensor 10 and the copy sensor 11 have been described as comprising optical detection means, but it is to be understood that any other suitable detection means can be employed in the present invention. For instance, as shown in FIG. 11, a combination of a mechanical detection means and an electronic detection means can be employed. That is, the actuating button or lever of a snap-action switch or microswitch 42 is connected to one end of a metal-wire actuator 43 the other end portion 43*a* of which is folded in the form of an inverted V and is extended upward through an opening 8*a* formed through the bottom of the copy discharge tray 8. When the copy or copies exist in the tray 8, the other end portion 43*a* is depressed so that the microswitch 42 is in the contact or out-of-contact position, but when the copy or copies are removed out of the tray 8, the other end portion 43*a* is permitted to extend upward through the aperture 8*a* so that the microswitch 42 is switched immediately to the out-of-contact or contact position. Thus, whether or not the copy or copies exist in the discharge tray 8 can be detected. The position of the opening 8*a* and hence the inverted-V-shaped end portion 43*a* of the actuator rod 43 is so selected that even when the smallest-size copy is discharged into the tray 8, the end portion 43*a* can be maintained in contact therewith.

In general, whether or not the master is left over the contact glass 3 is detected by optical means as described above, but it is to be understood that any other suitable detection means can be employed. For instance, in the case of the copying machine of the type the master is pressed against the contact glass with the pressure plate as described above, the master cannot be removed out of the contact glass 3 without opening or lifting the pressure plate 5 after a predetermined number of copies have been prepared. Therefore, a switch can be disposed which detects whether the pressure plate is closed or pressed against the master 4 or it is opened or lifted away from the master 4. And the alarm signal generating circuit can be so designed and constructed that the alarm indicator 16 is energized when the copy or copies are taken out of the tray 8 without lifting the pressure plate 5.

As described previously, the automatic document feeder 17 can automatically feed the master or original one by one to the contact glass 3 and holds it at a predetermined exposure position. Therefore, the alarm signal generating circuit can be so designed and constructed that the warning signal is generated when the copy or copies are taken out of the tray 8 when the automatic document feeder 17 malfunctions so that no master is fed from it to the contact glass 3 and consequently the sensor switch at the discharge end of the automatic document feeder 17 remains de-energized. In the case of malfunction of the automatic document feeder 17, the remaining masters or originals 4 can be removed out of it by opening the cover thereof. Therefore, the alarm signal generating circuit can be so designed and constructed that the warning signal is generated if the copy or copies are taken out of the tray 8 without opening the cover of the automatic document feeder 17.

Figure 12:
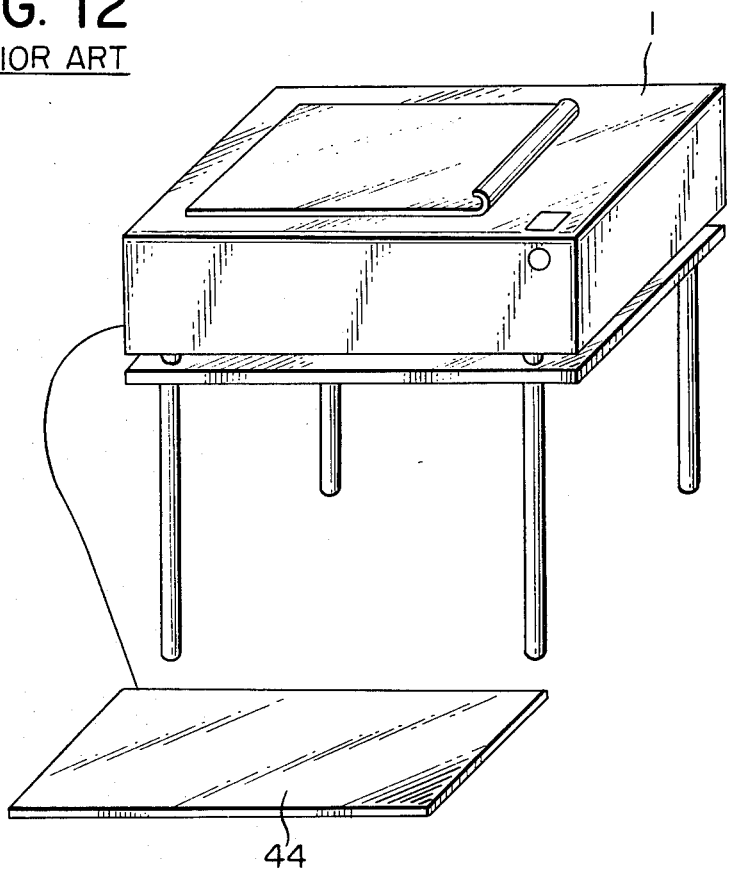
FIG. 12 PRIOR ART
FIG. 12 shows a conventional operator sensor.

As the operator sensor, a conventional mattress type foot switch or pressure-sensitive switch 44 as shown in FIG. 12 can be used. But the use of such foot switch 44 imposes limits on the installation positions of copying machines. Furthermore, the foot switch 44 must be moved as the copying machine 1 is moved. This is troublesome.

An optical detection means can be used for detecting the presence or absence of the operator. However, the intensity of light beam reflected back from the operator widely varies depending upon the color of the clothing that the operator is wearing so that the dynamic range of the light sensor must be increased. In addition, the sensitivity of the light sensor varies depending upon the illumination of the room. Therefore, it is preferable to use an ultrasonic detection means in the present invention as will be described in detail below.

Figure 13:
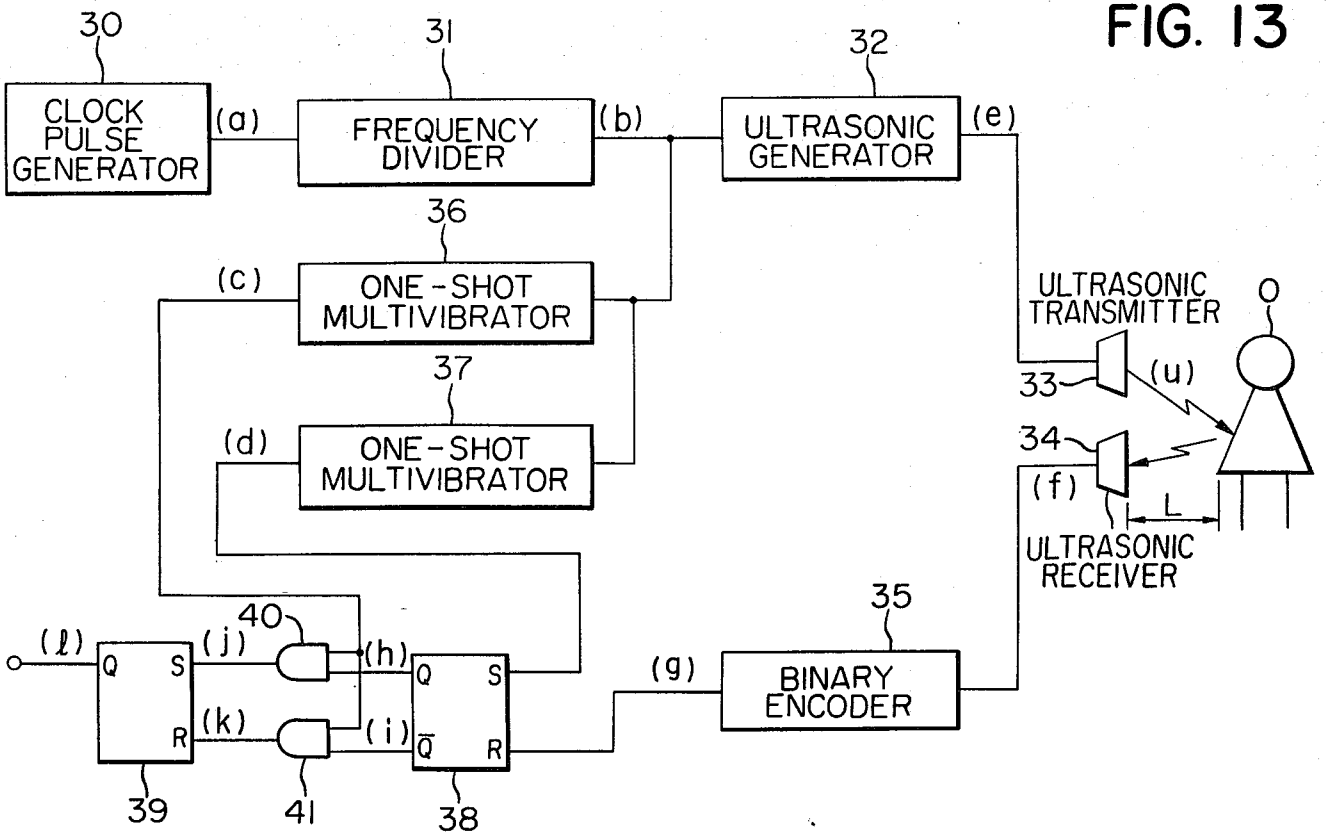
FIG. 13 is a block diagram of an ultrasonic range finder in accordance with the present invention which is used as the operator sensor.

In FIG. 13 is shown a circuit diagram of an ultrasonic range finder which can be used as an operator sensor in the present invention. It comprises a clock pulse generator 30, a frequency divider 31, an ultrasonic generator 32, an ultrasonic transducer or transmitter 33, an ultrasonic detector or receiver 34, a binary encoder 35, monostable multivibrators or one-shot multivibrators 36 and 37, flip-flops 38 and 39 and AND gates 40 and 41.

Figure 14:
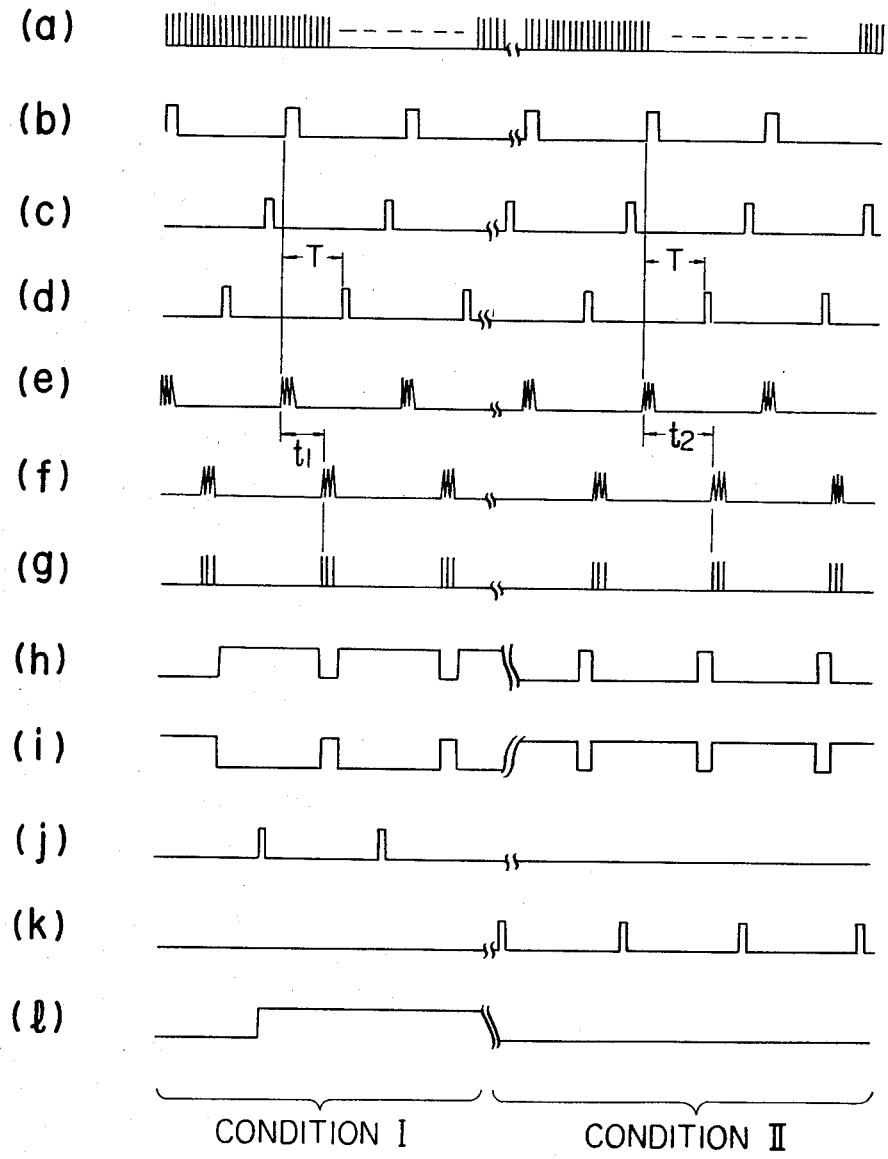
FIG. 14 shows various waveforms used to explain the mode of operation thereof.

Referring further to FIG. 14 showing the waveforms at the points (a) to (l) in FIG. 13, the mode of operation of the operator sensor will be described. The clock pulse generator 30 generates the clock pulses as shown at (a) in FIG. 14 and the frequency divider 31 converts these clock pulses into the fundamental pulse signal or master clock as shown at (b) in FIG. 14. The ultrasonic generator 32 converts the master clock (b) into the ultrasonic frequency signal (e) which in turn is transformed by the ultrasonic transducer or transmitter 33 into the ultrasonic waves (u) which are transmitted to the operator O. The ultrasonic waves (u) reflected back from the operator O is received by the ultrasonic detector or receiver 34 to be transformed into the signal (f) which in turn is converted by the binary encoder 35 into the digital signal (g).

A time interval t from the time when the ultrasonic waves (u) are transmitted from the transmitter 33 to the time when the ultrasonic receiver 34 receives the reflected ultrasonic wave (u); that is, a time interval from the time when the master clock (b) is derived from the frequency divider 31 to the time when the digital output signal (g) is derived from the digital encoder 35 is given by $$t=L/(2\times V) \quad (1)$$

where

L = the distance from the transmitter 33 (or receiver 34) to the operator O; and V = the velocity of the sound.

The output or the pulse signal (b) from the frequency divider 31 is applied to the one-shot multivibrators 36 and 37 which in turn generate the pulses (c) and (d), respectively. The time interval T from the time when the multivibrator 37 is triggered in response to the pulse (b) from the frequency divider 31 to the time when it generates the pulse signal (d) is determined to satisfy the following relationship:

$$T=L_1/(2\times V) \quad (2)$$

where $L_1$ is the longest distance between the copying machine and the position of the operator at which he or she can operate the copying machine that is, the distance of a predetermined operational range from the copying machine; and V is the velocity of the sound.

The pulse (d) from the one-shot multivibrator 37 is applied to the S input of the flip-flop 38 while the digital signal (g) from the binary encoder 35 is applied to the R input thereof. When $t=t_1<T$ (the condition is referred to as "the condition I".), the time interval during which the Q output (h) of the flip-flop 38 remains at the high level becomes longer than the time interval during which it remains at the low level. However, if $t=t_2>T$ (this condition is referred to as "the condition II".), the time interval during which the Q output (h) remains at the low level becomes longer than the time interval during which it remains at the high level. The output (c) from the one-shot multivibrator 36 and the Q output (h) from the flip-flop 38 are applied to the AND gate 40 which delivers the output (j) only under the condition I.

The $\overline{Q}$ output (i) from the flip-flop 38 is out of phase by 180° from the Q output (h) therefrom and is applied to the AND gate 41 to which is also applied the output (c) from the one-shot multivibrator 36. The AND gate 41 delivers the output (k) only under the condition II.

The output (j) from the AND gate 40 is applied to the S-input of the flip-flop 39 while the output (k) from the AND gate 41 to the R input thereof. Therefore, the Q output (l) of the flip-flop 39 remains at the high level under the condition I but at the low level under the condition II.

With the ultrasonic range finder of the type described above, whether or not the operator is within a predetermined range from the copying machine can be positively detected. Opposed to the optical operator sensor, the detection is not adversely affected by the color of the clothing that the operator is wearing or the illumination conditions of the room in which is installed the copying machine. Thus, the highly reliable detection of the operator can be ensured.

In summary, according to the present invention, if the operator leaves the copying machine without taking out the master or original from the contact glass, the warning signal is generated so that the master or original can be prevented from being left behind. Consequently, the loss of a valuable master can be avoided. In addition, the present invention can be equally applied to both the dry and wet type copying machines.

What is claimed is:

1. In a copying machine an alarm system for giving the warning signal that a master is left behind, comprising a master detection means for detecting whether or not a master is set on the master stand, a copy detection means for detecting whether or not one or more copies exists in the copy discharge tray, and an alarm indicator adapted to be activated when said copy detection means detects that no copy exists in the copy discharge tray and said master detection means detects the master still remaining on the master stand after the completion of one copying operation.

2. In a copying machine, an alarm system for giving the warning signal that a master is left behind, comprising a master detection means for detecting whether or not a master is set on the master stand, an operator detection means for detecting whether or not an operator is within a predetermined range from the copying machine, and an alarm indicator adapted to be activated when said master detection means detects the master still remaining on the master stand and said operator detection means detects that the operator is out of said predetermined range after the completion of one copying operation.

3. An alarm system as set forth in claim 2 wherein said operator detection means comprises an ultrasonic range finder so that whether or not the operator is within said predetermined range is detected by the comparison of a reference time interval with a time interval measured from the time when the ultrasonic beam is transmitted from an ultrasonic transmitter to the time when the ultrasonic beam reflected back from the operator is received by an ultrasonic receiver.

4. An alarm system as set forth in claim 2 wherein a copy detection means for detecting whether or not one or more copies exist in the copy discharge tray is provided, and said alarm indicator is activated when, after the completion of one copying operation, said copy detection means detects that no copy exists in the copy discharge tray, said operator detection means detects that the operator is out of said predetermined range and said master detection means detects that the master still remains set on the master stand.

5. An alarm system as set forth in claim 4 wherein said operator detection means comprises an ultrasonic range finder, whereby whether or not the operator is within said predetermined range is detected by the comparison of a reference time interval with a time interval measured from the time when the ultrasonic beam is transmitted from an ultrasonic transmitter to the time when the ultrasonic beam reflected back from the operator is received by an ultrasonic receiver.

* * * * *